US007488221B2

(12) United States Patent
Tanaka et al.

(10) Patent No.: US 7,488,221 B2
(45) Date of Patent: Feb. 10, 2009

(54) CONNECTOR

(75) Inventors: Tsutomu Tanaka, Yokkaichi (JP); Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/123,086

(22) Filed: May 19, 2008

(65) Prior Publication Data

US 2008/0293281 A1 Nov. 27, 2008

(30) Foreign Application Priority Data

May 21, 2007 (JP) ..... 2007-133867

(51) Int. Cl.
*H01R 13/514* (2006.01)

(52) U.S. Cl. ..... 439/752

(58) Field of Classification Search ..... 439/595, 439/871, 752

See application file for complete search history.

(56) References Cited

U.S. PATENT DOCUMENTS

2003/0087562 A1* 5/2003 Okamoto et al. ..... 439/752
2005/0233652 A1 10/2005 Tsuji
2007/0218780 A1* 9/2007 Onoda et al. ..... 439/752

FOREIGN PATENT DOCUMENTS

JP 2002231364 8/2002
JP 2002-313475 10/2002

* cited by examiner

*Primary Examiner*—Tho D Ta
(74) *Attorney, Agent, or Firm*—Gerald E Hespos; Anthony J. Casella

(57) ABSTRACT

Larger cavities (15, 16) for accommodating large terminals (6) are arranged at the opposite lateral sides of a housing (1), and small cavities (20) for accommodating small terminals (7) are arranged between the large cavities (15, 16). A retainer (4) is inserted laterally through a side surface of the housing (1). Lances (14) in the large cavities (16) at the trailing side with respect to an inserting direction of the retainer (4) are arranged on a passage route of the retainer (4), and hence are formed in a front holder (5) to be assembled after insertion of the retainer (4). Thus, the arrangement positions of the large cavities (16) are not restricted to the leading side with respect to the inserting direction of the retainer (4).

20 Claims, 15 Drawing Sheets

CONNECTOR

BACKGROUND OF THE INVENTION

1. Field of the Invention

The invention relates to a connector.

2. Description of the Related Art

Japanese Unexamined Patent Publication No. 2002-313475 relates to a connector that has terminal fittings with sizes that differ according to allowable current values. A housing of this connector has locking lances to lock the terminal fittings in the cavities and a side-mounted retainer for doubly locking the terminal fittings.

Positions of terminal fittings locked by the lances and by the retainer are displaced in forward and backward directions according to the size of the terminal fitting. Locking positions for large terminal fittings are rearward of the locking positions for small terminal fittings. Normally, the positions of small terminals locked by the retainer and the large terminals locked by the lances are overlapped with respect to an inserting direction of the terminal fittings. Accordingly, cavities for the large terminals must be more backward than cavities for the small terminals with respect to an inserting direction of the side-mounted retainer to avoid interference between the retainer and the locking lances for the large terminals. Thus, as disclosed in Japanese Unexamined Patent Publication No. 2002-313475, the cavities for the large terminals are arranged intensively at the back side with respect to the inserting direction of the retainer. This has reduced a degree of freedom in arranging the cavities.

The invention was developed in view of the above situation and an object thereof is to provide a connector capable of improving a degree of freedom in the arrangement of cavities.

SUMMARY OF THE INVENTION

The invention relates to a connector with a housing that has cavities to accommodate terminal fittings and lances for locking the terminal fittings in the cavities. The connector also includes a retainer that is insertable into a side surface of the housing and along a direction intersecting a longitudinal direction of the cavities. The retainer is engageable with the terminal fittings in the cavities to retain the terminal fittings. Lances located on a passage route of the retainer are formed separately from the housing and are assembled into the housing after the insertion of the retainer. Accordingly, the locking lances can be arranged on the passage route of the retainer. Thus, a degree of freedom in the arrangement of the cavities can be increased.

The separate locking lances preferably are assembled at or close to the back side with respect to an inserting direction of the retainer. These separate locking lances prevent the retainer from coming out of the housing.

The housing preferably has a front holder formed with front end portions of the cavities. The separate locking lances preferably are integral or unitary with the front holder. Thus, it is possible to reduce the constituent parts of the connector and to simplify the construction.

Cavities at the back and front sides with respect to the inserting direction of the retainer may be large cavities for large terminal fittings. Cavities between the large cavities may be small cavities for small terminal fittings.

The separate locking lances preferably are assembled with the large cavities located at the back side with respect to the inserting direction of the retainer, and integral locking lances are formed in the large cavities at the front side with respect to the inserting direction of the retainer. Accordingly, the large terminal fittings that cause large frictional resistance at the time of connecting male and female connectors are arranged at the opposite sides of the housing. Thus, connection resistance can be balanced in the transverse direction of the housing, and the male and female connectors can be connected smoothly.

The front holder preferably includes tubular bodies having the separate locking lances formed inside. The tubular bodies preferably are located at the back side with respect to the inserting direction of the retainer when the front holder is mounted.

The retainer preferably is movable between a first position for permitting insertion of the terminal fittings into the cavities, and a second position for locking the terminal fittings in the cavities.

The retainer preferably has an operable portion projecting laterally out of the tubular bodies while avoiding interference with the tubular bodies.

Accordingly, if the front holder is assembled after the retainer is at the partial locking position, the tubular bodies of the front holder are at the back side with respect to the inserting direction of the retainer. The terminal fittings then are inserted into the small cavities. Thereafter, the retainer is moved to the full locking position. The operable portion of the retainer is laterally outward of the tubular bodies at this time. Thus, the retainer can be moved easily from the partial locking position to the full locking position only by pushing the operable portion despite the fact that the retainer is located behind the tubular bodies.

A seal ring preferably is provided at an inner back side of the housing for providing sealing between the housing and a mating housing. The seal ring is more backward than the retainer and is retained by the retainer. Accordingly, a special member for preventing the detachment of the seal ring is unnecessary, with the result that the number of the parts can be reduced.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
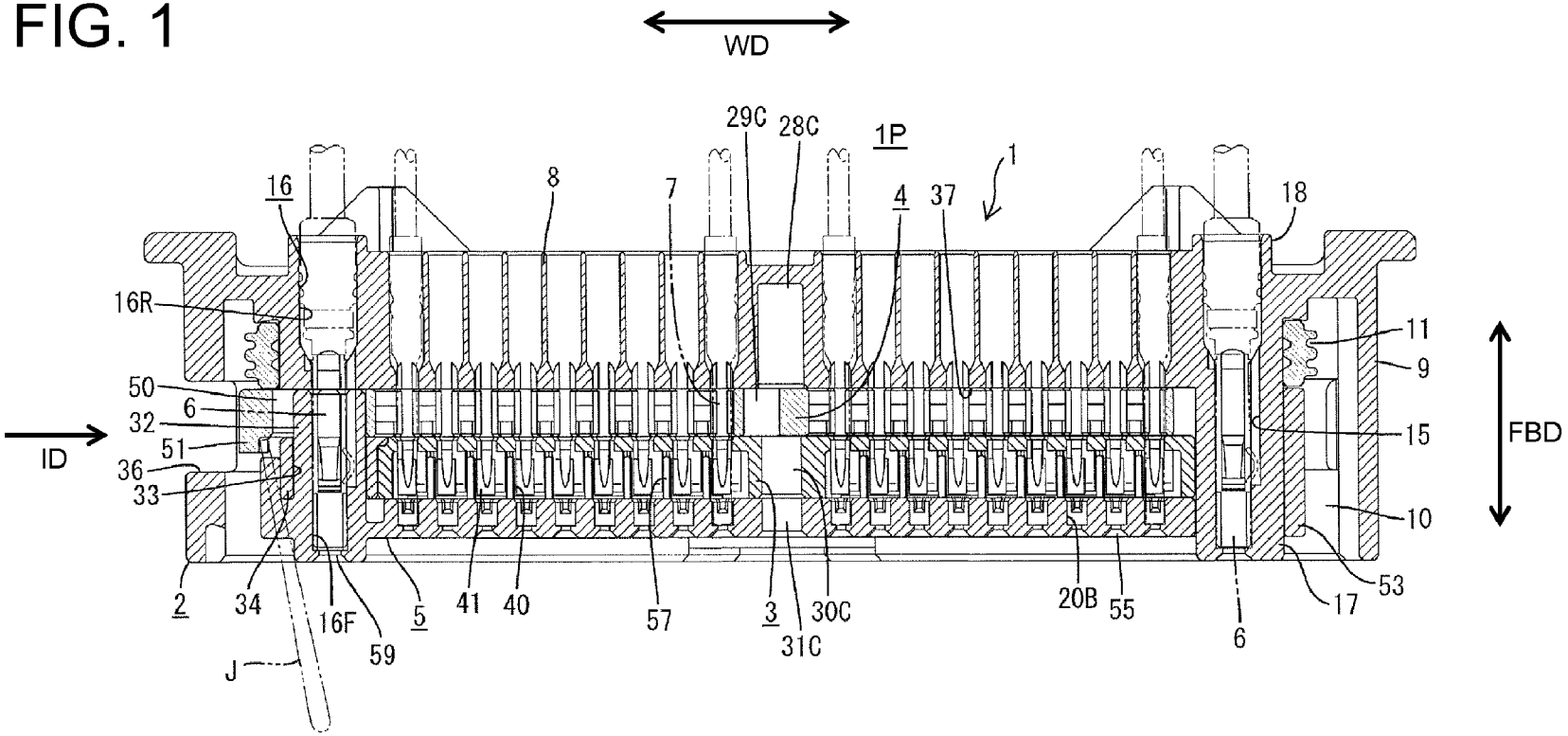
FIG. 1 is a plan view of a connector when a retainer is at a partial locking position.

A female connector in accordance with the invention is described with reference to FIGS. 1 to 15 and includes a housing 1 with a housing main body 2. The connector also has a lance housing 3 and a front holder 5 including a retainer 4.

The housing main body 2 is formed unitarily e.g. of a synthetic resin and includes a terminal accommodating portion 8 for accommodating large and small female terminals 6 and terminals 7. A lever accommodating portion 9 at least partly surrounds the terminal accommodating portion 8.

A connection space 10 is defined between the terminal accommodating portion 8 and the inner surface of the lever accommodating portion 9 for the connection with an unillustrated male connector. A resilient rubber sealing ring 11 is mounted at the back end of the terminal accommodating portion 8 to provide sealing between the two connectors by closely contacting substantially the entire circumferential surface of the male connector when the male connector is fit into the connection space 10.

Lever accommodating spaces 12 are formed by hollowed parts of the lever accommodating portion 9 facing each other in the height direction and accommodate a slide-type lever 13. The lever accommodating spaces 12 are open at both sides in the width direction of the housing main body 2. The lever 13 is formed with cam grooves. Cam followers of the male connector are moved along the cam grooves in the lever 13 as the lever 13 is moved and the male and female connectors can be connected with a small operation force by the cam action displayed.

Figure 4:
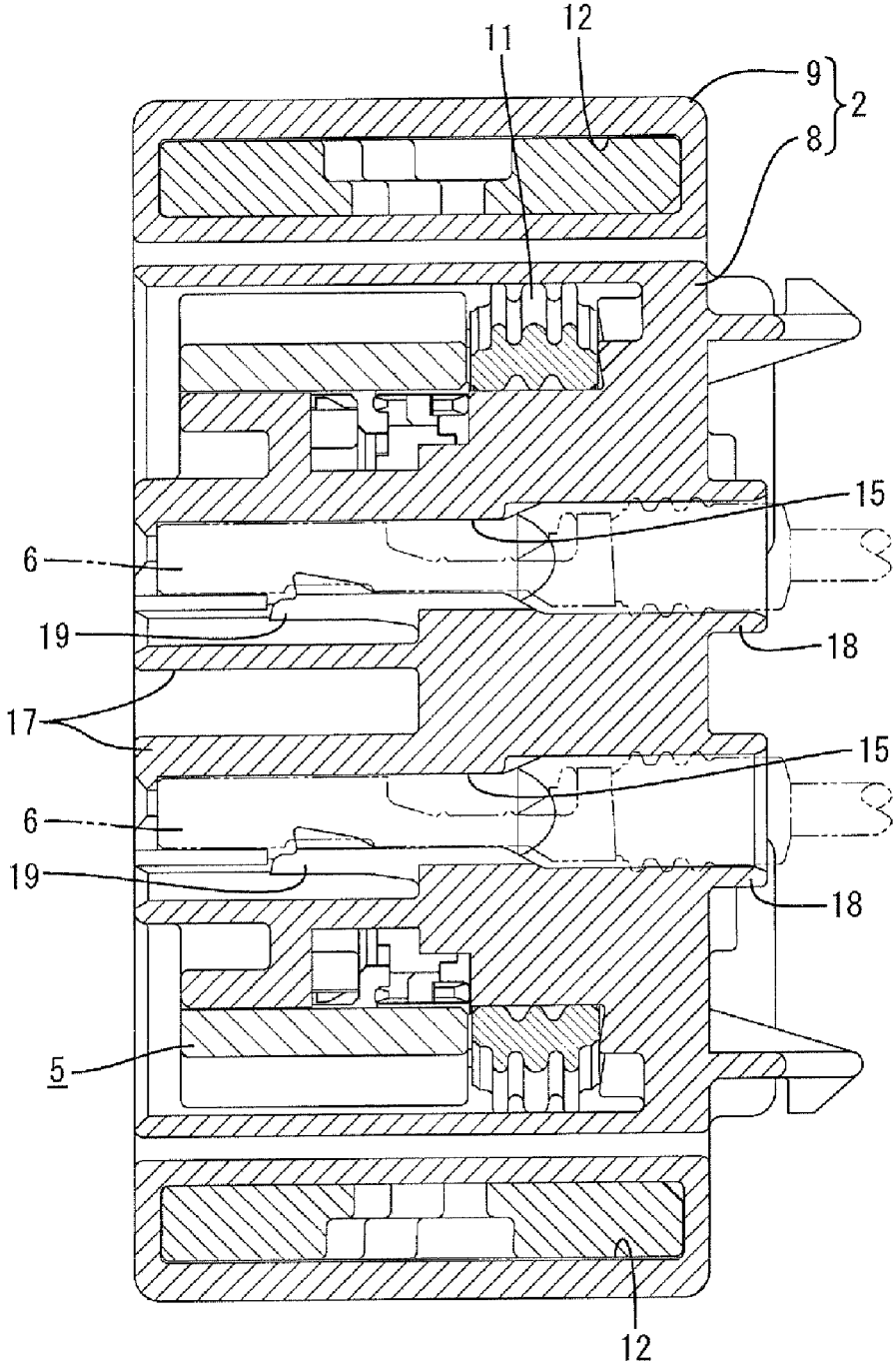
FIG. 4 is a side view in section showing larger cavities at a side where integral locking lances are provided.
Figure 5:
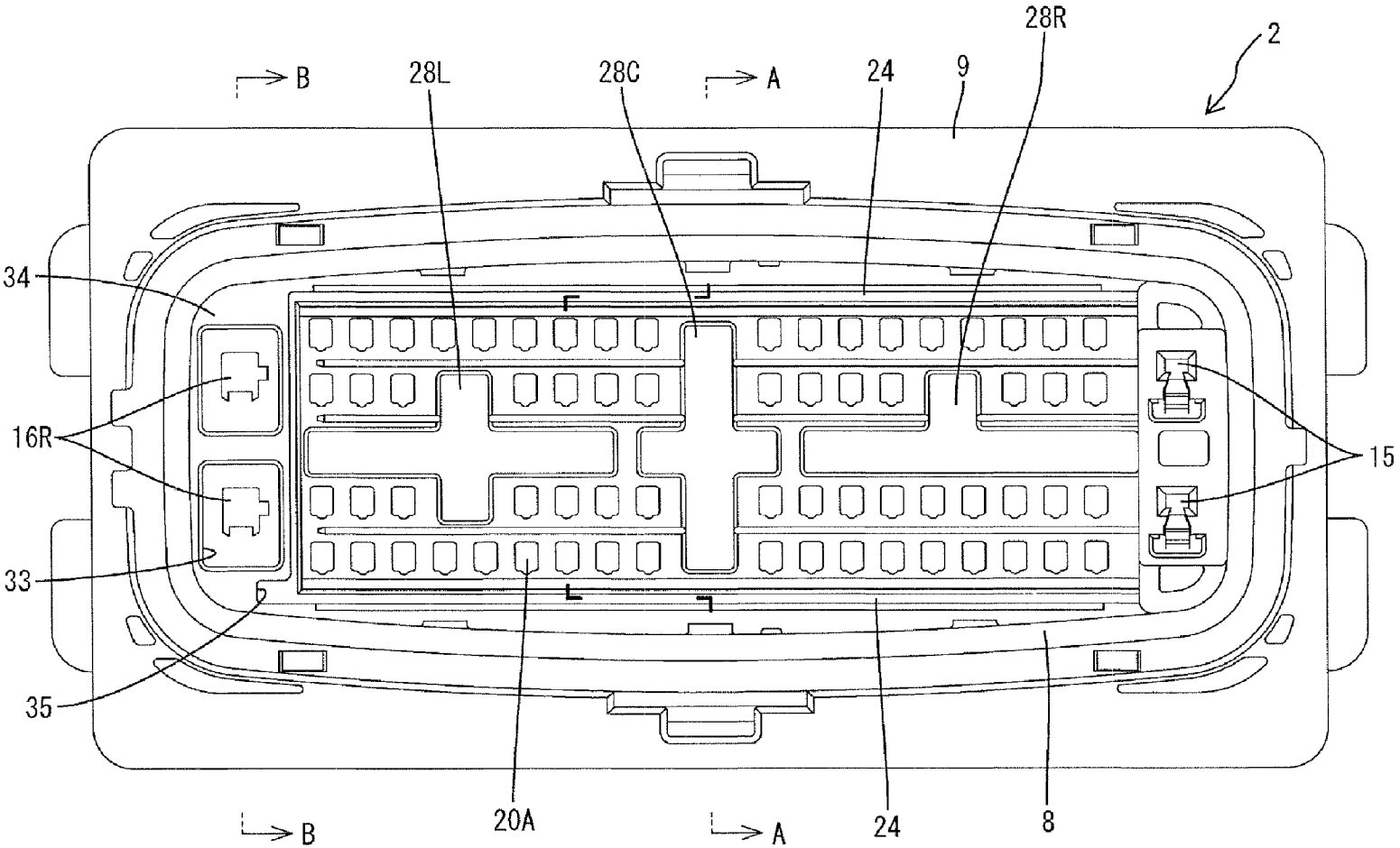
FIG. 5 is a front view of a housing main body.

The terminal accommodating portion 8 has cavities 15, 16 to accommodate large terminal fittings. More particularly, two large cavities 15, 16 are arranged one above the other at each of the opposite widthwise sides of the terminal accommodating portion 8 for accommodating the large terminals 6. Rear chambers 20A constituting small cavities 20 are arranged in the width direction WD between the large cavities 15, 16 at four stages arranged in the height direction. The right large cavities 15 in FIG. 5 are formed in upper and lower large cavity tubes 17. The large cavity tubes 17 are formed unitarily from sealing towers 18 to the surfaces of front-stop walls for the large terminals 6. Additionally, the front end surfaces thereof are aligned with the front end surfaces of the housing main body 2 as shown in FIG. 4. The sealing towers 18 of the back-side large cavities 15 sealingly accommodate resilient rubber plugs mounted on the rear ends of the large terminals 6. Locking lances 19 are formed unitarily in the back-side large cavities 15 and are resiliently engageable with the large terminals 6. The locking lances 19 are cantilevered forward in the mounting direction of the terminals 6 into the cavities 15 and are resiliently deformable in the height direction.

Figure 7:
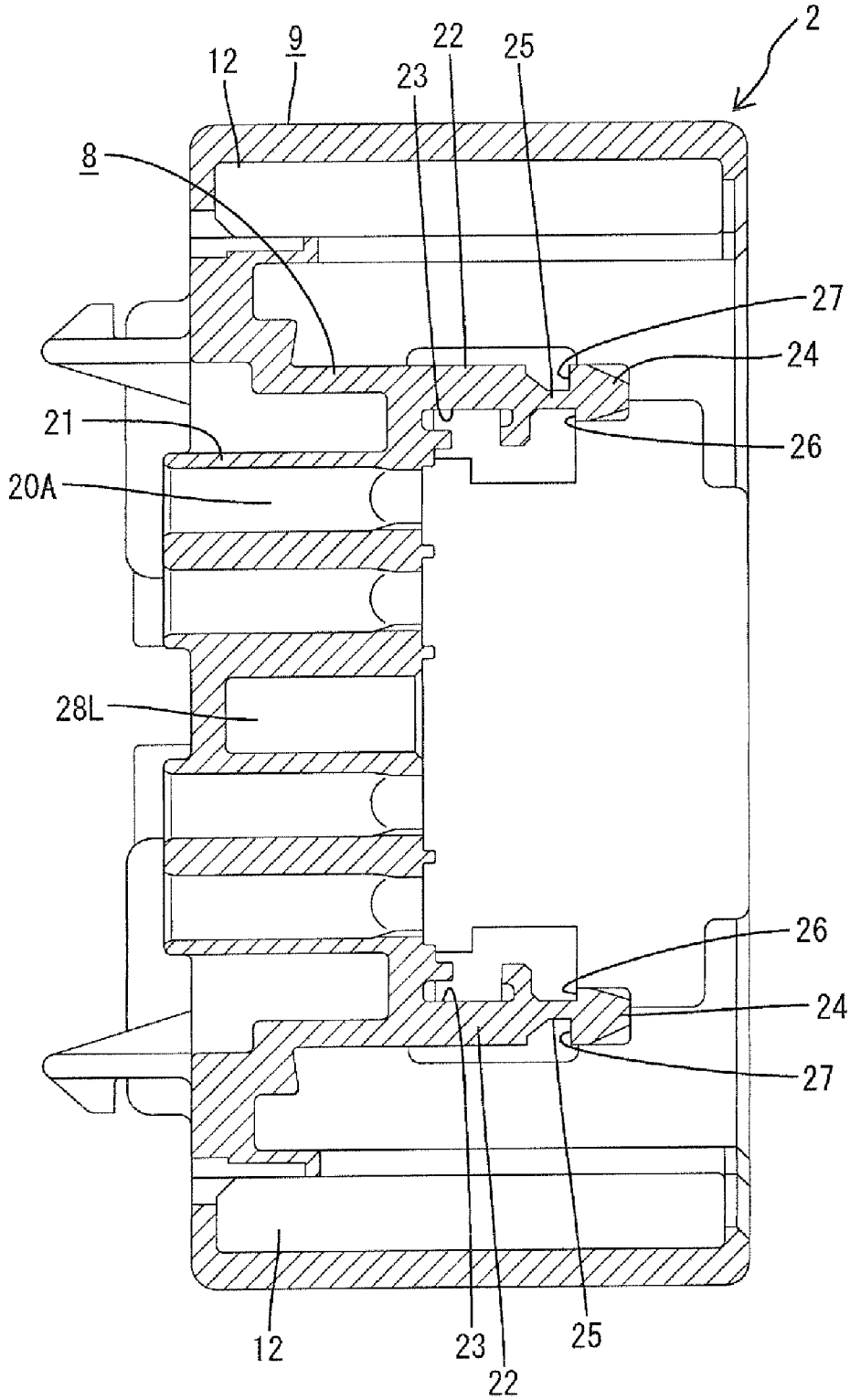
FIG. 7 is a section along A-A of FIG. 5.
Figure 8:
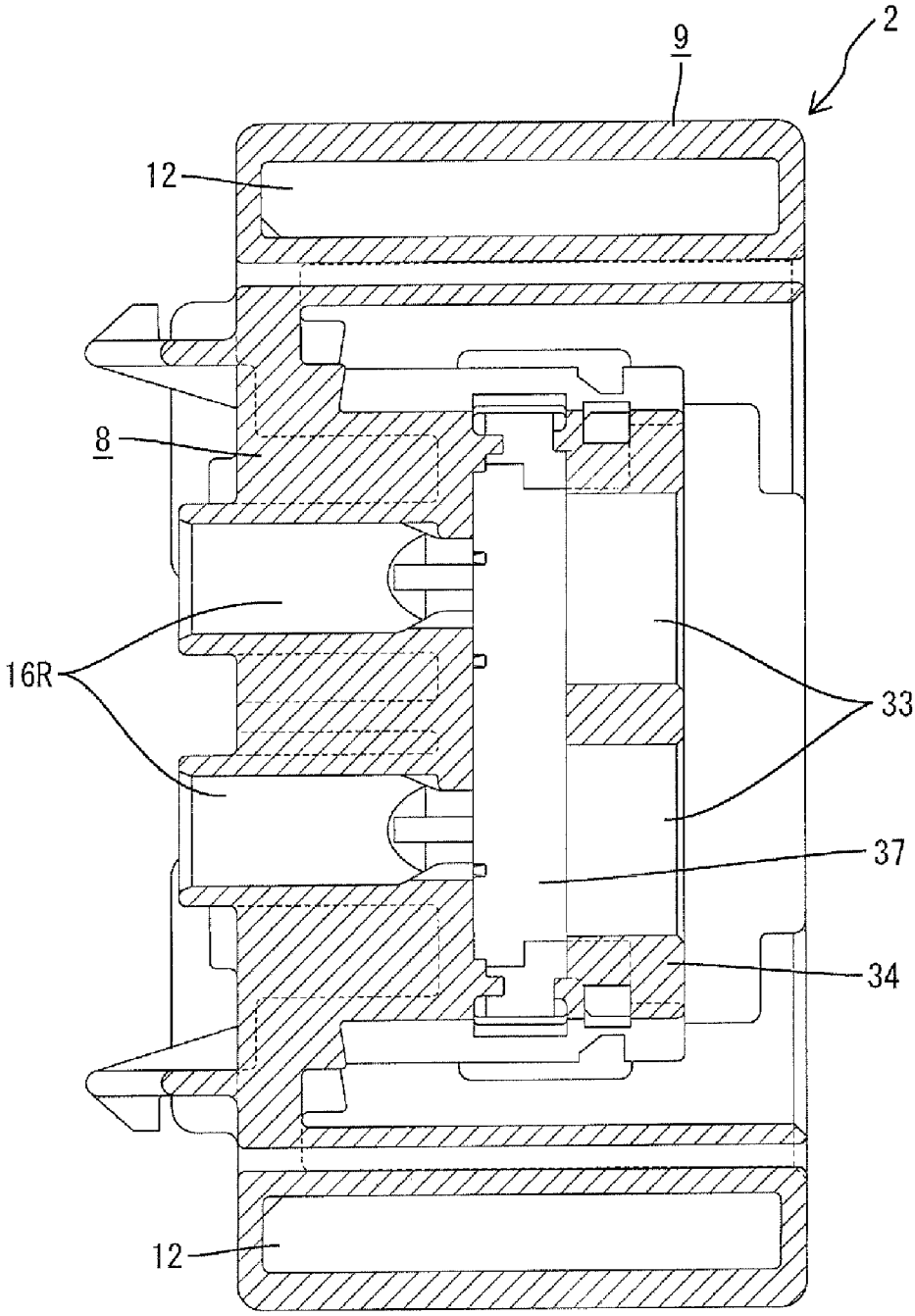
FIG. 8 is a section along B-B of FIG. 5.

The rear chambers 20A of the smaller cavities 20 are formed in a sealing tower 21, as shown in FIG. 7, and front parts of the smaller cavities 20 are separated from the sealing tower 21. The respective rear chambers 20A can accommodate the small terminals 7 from the resilient plugs to the rear portions of the wire barrels that are to be crimped, bent or folded into connection with cores of wires. Two projections 22 project forward from opposite top and bottom positions on the front surface of the terminal accommodating portion 8 and channel-shaped guide grooves 23 are formed in the upper and lower facing surfaces of the projections 22. The guide grooves 23 extend over the entire width of the projections 22 and guide the insertion of the retainer 4. Upper and lower locks 24 are disposed forward of the front surfaces of the projections 22 and connecting pieces 25 extend between the projections 22 and the locks 24. Inner and outer locking steps 26 and 27 are defined on the rearwardly facing surfaces of the locks 24. The inner locking steps 26 engage the lance housing 3 and the outer locking steps 27 engage the front holder 5.

Three guiding recesses 28R, 28L, 28C are arranged side by side in the width direction WD across an area of the front surface of the terminal accommodating portion 8 with the rear chambers 20A (see FIG. 5) and guide the connection with the unillustrated male connector. The shapes of the openings of the guiding recesses 28R, 28L, 28C differ in front view. Holes 29R, 29L, 29C to 31R, 31L, 31C penetrate the retainer 4, the lance housing 3 and the front holder 5 at positions corresponding to the respective guiding recesses 28R, 28L and 28C. The respective guiding recesses 28R, 28L, 28C and the corresponding holes 29R, 29L, 29C to 31R, 31L, 31C form guide paths that extend in forward and backward directions FBD when the retainer 4 and the like are assembled to complete the connector. Guiding projecting pieces project at substantially corresponding positions on the unillustrated male connector and can be inserted into the guide paths as the connectors are connected to guide the connection of the two connectors.

Upper and lower front side large cavities 16 are formed in the terminal accommodating portion 8 at a side substantially opposite the back-side large cavities 15 and include integral locking lances 19. As shown in FIG. 1 and other figures, the front ends of rear halves 16R of the upper and lower front-side larger cavities 16 are aligned substantially with the front ends of the rear chambers 20A in plan view. A supporting block 34 is arranged before the rear halves 16R of the front-side larger cavities 16, and upper and lower through holes 33 are formed in the supporting block 34 substantially coaxially with the corresponding rear halves 16R. The through holes 33 receive tubular bodies 32 formed on the front holder 5, as shown in FIG. 1.

As shown in FIG. 5, an escaping groove 35 extends in the forward and backward directions FBD in the bottom end surface of the supporting block 34 and at a side adjacent to the area where the rear chambers 20A are arranged. This escaping groove 35 extends over substantially the entire length of the supporting block 34 and functions to prevent the lance housing 3 from being mounted in an improper or inverted posture.

Figure 6:
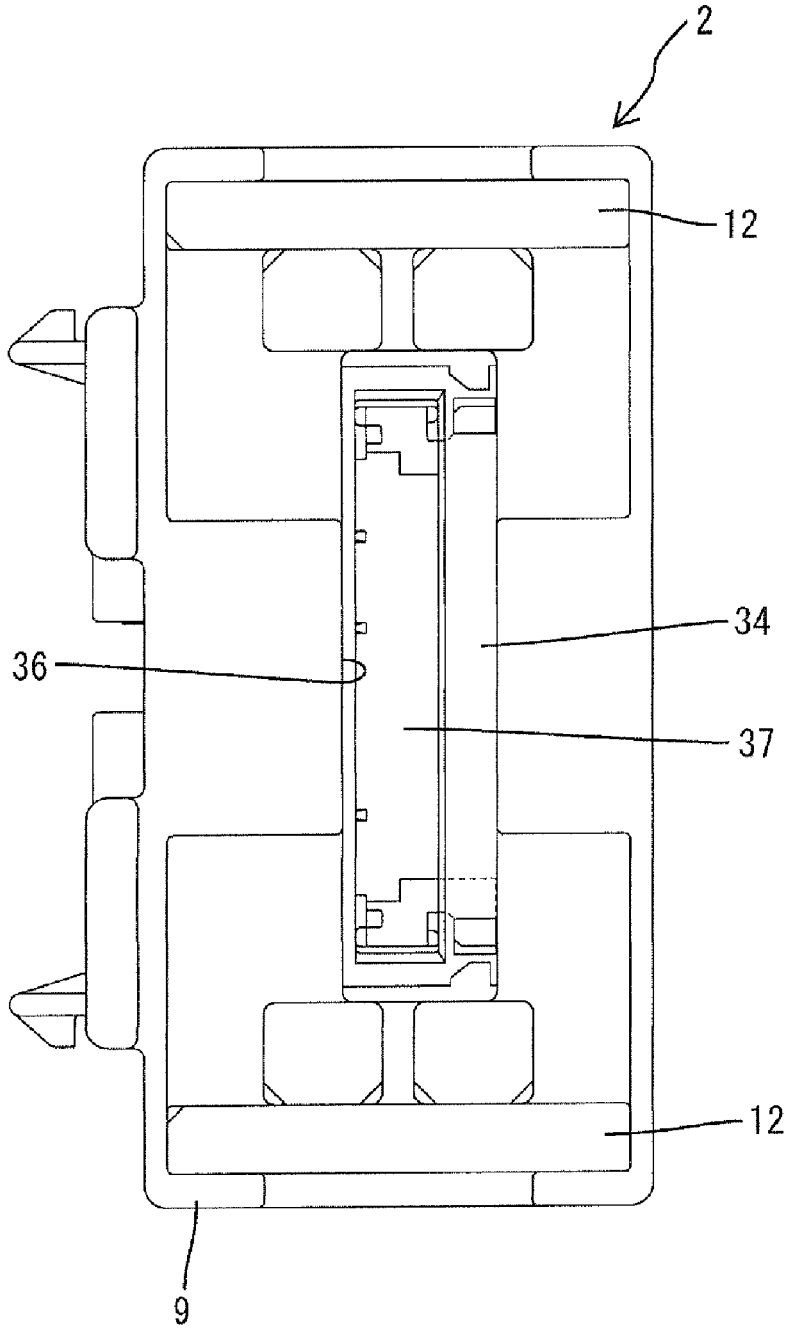
FIG. 6 is a side view of the housing main body.

An insertion window 36 is formed in a side of the lever accommodating portion 9 for receiving the retainer 4 (see FIG. 6). A retainer accommodating hole 37 is formed in a surface of the terminal accommodating portion 8 facing the insertion window 36 for accommodating the retainer 4. The retainer accommodating hole 37 is smaller in forward and backward directions FBD than the insertion window 36, and the entrance of the retainer accommodating hole 37 is exposed entirely in the insertion window 36. The retainer accommodating hole 37 includes a space between the front surface and the lance housing 3 near the front surface of the area where the rear chambers 20A of the smaller cavities 20 are formed. Thus, the retainer accommodating hole 37 is formed in a length range so that the back end thereof is at the boundary wall with the back-side large cavities 15.

The lance housing 3 is formed e.g. of the synthetic resin to define a rectangular plate that is long in the width direction. The lance housing 3 is dimensioned to conform to the area of the housing main body 2 with the rear chambers 20A of the small cavities 20. Hooks 39 project over the entire width at the rear ends of the upper and lower edges of the lance housing 3 and are engageable with the inner locking steps 26 of the housing main body 2. Thus, the lance housing 3 faces the housing main body 2 with the rear end thereof spaced from the housing main body 2 by a distance equal to or slightly larger than the thickness of the retainer 4 in forward and backward directions FBD to define the retainer accommodating hole 37, and is held so as not to come out forward. The lance housing 3 has as many intermediate chambers 40 as the respective rear chambers 20A of the housing main body 2, and the intermediate chambers 40 communicate with the rear chambers 20A. Lances 41 cantilever forward from the bottom surfaces inside the respective intermediate chambers 40. The lances 41 are resiliently deformable in a direction intersecting the mounting direction of the terminals, and the leading ends of the lances 41 are retracted slightly in from the front end of the lance housing 3 so as not to project forward from the lance housing 3. An unlocking piece 42 projects out in the width direction WD from one side surface of each lance 41. There are no side walls between intermediate chambers 40 adjacent in the width direction WD, so that the intermediate chambers 40 communicate with each other. Further, receiving grooves 43 of triangular cross section face each other in the height direction and extending in the depth direction in the upper and lower surfaces of the interspaces between the adjacent intermediate chambers 40.

Figure 9:
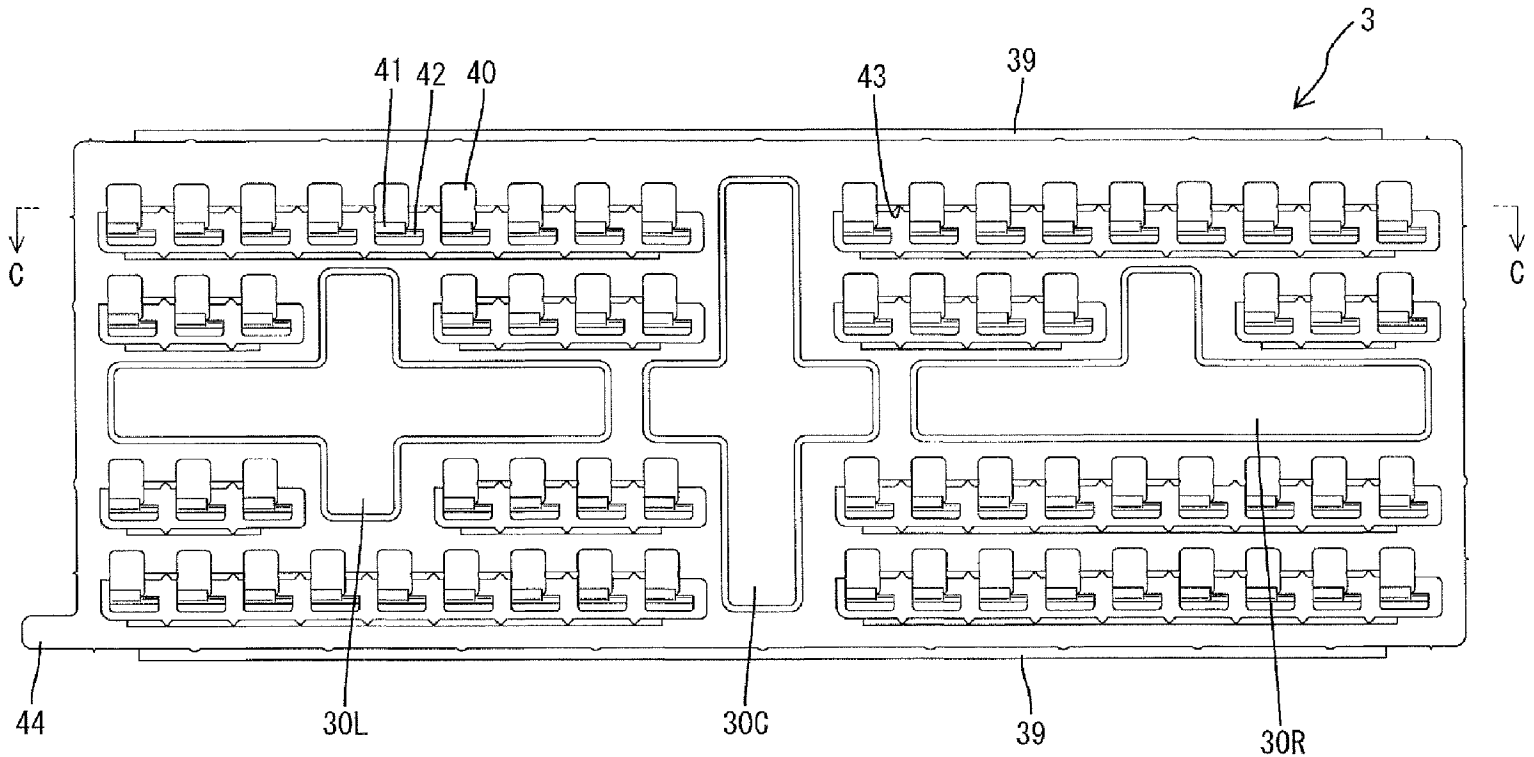
FIG. 9 is a front view of a lance housing.
Figure 10:
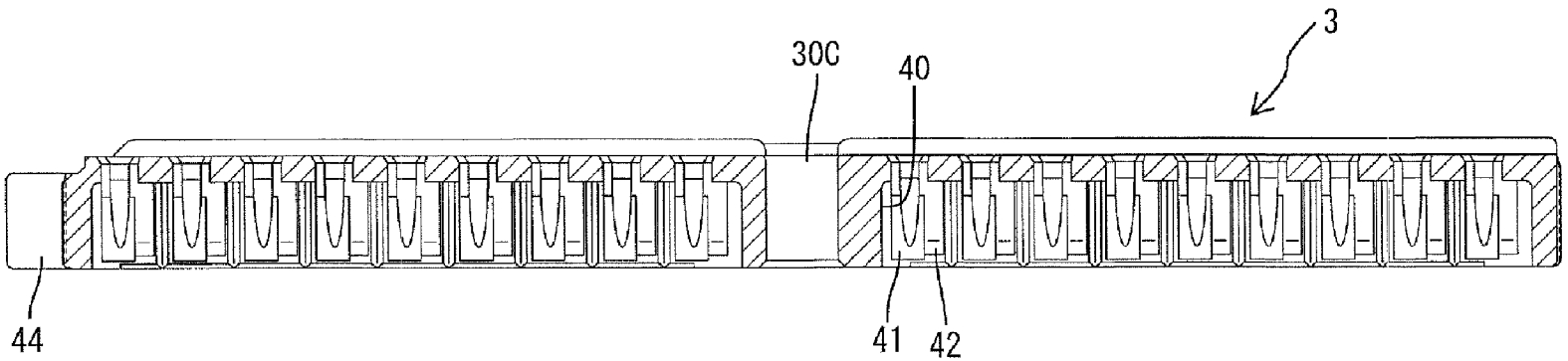
FIG. 10 is a section along C-C of FIG. 9.

A positioning projection 44 projects laterally out at the bottom end of one side surface of the lance housing 3 (left surface in FIG. 9). The positioning projection 44 aligns with and fits into the escaping groove 35 of the housing main body 2 when the lance housing 3 is assembled in a proper posture into the housing main body 2, but interferes with the housing main body 2 to prevent assembly when the lance housing 3 is in an improper posture.

The retainer 4 is formed unitarily e.g. of the synthetic resin into a plate. The retainer 4 is insertable in the inserting direction ID through the insertion window 36 and into the retainer accommodating hole 37 of the housing main body 2. Terminal holes 45 are arranged at four stages in the height direction of the retainer 4 to communicate with the rear chambers 20A of the housing main body 2. The terminal holes 45 correspond with groups formed by the rear chambers 20A at the respective stages of the housing main body 2 partitioned by the guiding recesses 28R, 28L and 28C, and have wide oblong shapes to communicate with the rear chambers 20A in the corresponding groups at once. Locking projections 46 are formed at the arrangement intervals of the rear chambers 20A on parts of the opening edges of the respective terminal holes 45, and are engageable with the small terminals 7 when the retainer 4 is inserted to a proper depth in the retainer accommodating hole 37, i.e. inserted to a full locking position 2P shown in FIG. 2.

Figure 15:
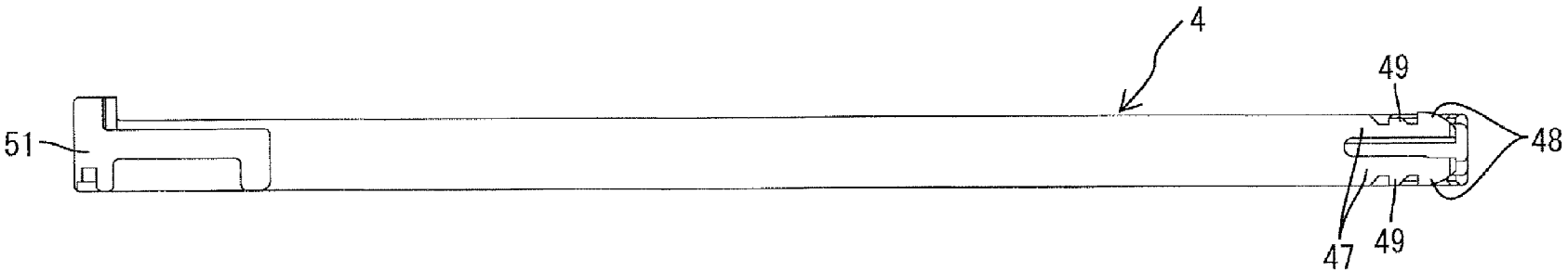
FIG. 15 is a bottom view of the retainer.

The retainer 4 can be inserted lightly in the retainer accommodating hole 37 and held at a partial locking position 1P (FIG. 1) where the terminal fittings may be inserted freely and withdrawn from the smaller cavities 20. The retainer 4 also can be inserted deeply in the retainer accommodating hole 37 in the inserting direction ID and held at the full locking position 2P where the retainer 4 engages the small terminals 7 and achieves redundant locking with the small terminals 7. Forked locking legs 47 are formed at opposite outer surfaces of the leading end of the retainer 4, as shown in FIG. 15, and can be deformed resiliently towards one another. Partial locking claws 48 are formed on the outer surfaces of both locking legs 47 near the leading ends and full locking claws 49 are formed at intermediate positions of these outer surfaces. Although not shown in detail, the partial locking claws 48 and the full locking claws 49 are engageable with partial engaging portions and full engaging portions on the wall surfaces of the back sides of the guide grooves 23 to hold the retainer 4 at the partial locking position 1P and at the full locking position 2P. The partial and full engaging portions are near a cutout 38 so that the engaged state can be canceled by a disengaging jig. The arcuately formed outer edges of the partial locking claws 48 enable the partly locked state to be canceled easily so that the retainer 4 can be moved from the partial locking position 1P to the full locking position 2P e.g. by strongly pushing the retainer 4.

The locking projections 46 are retracted sideways from the small cavities 20 when the retainer 4 is at the partial locking position 1P so that the small terminals 7 can be inserted in and withdrawn from the small cavities 20. The locking projections 46 enter the cavities 20 when the retainer 4 is moved to the full locking position 2P and engage the small terminals 7.

Figure 2:
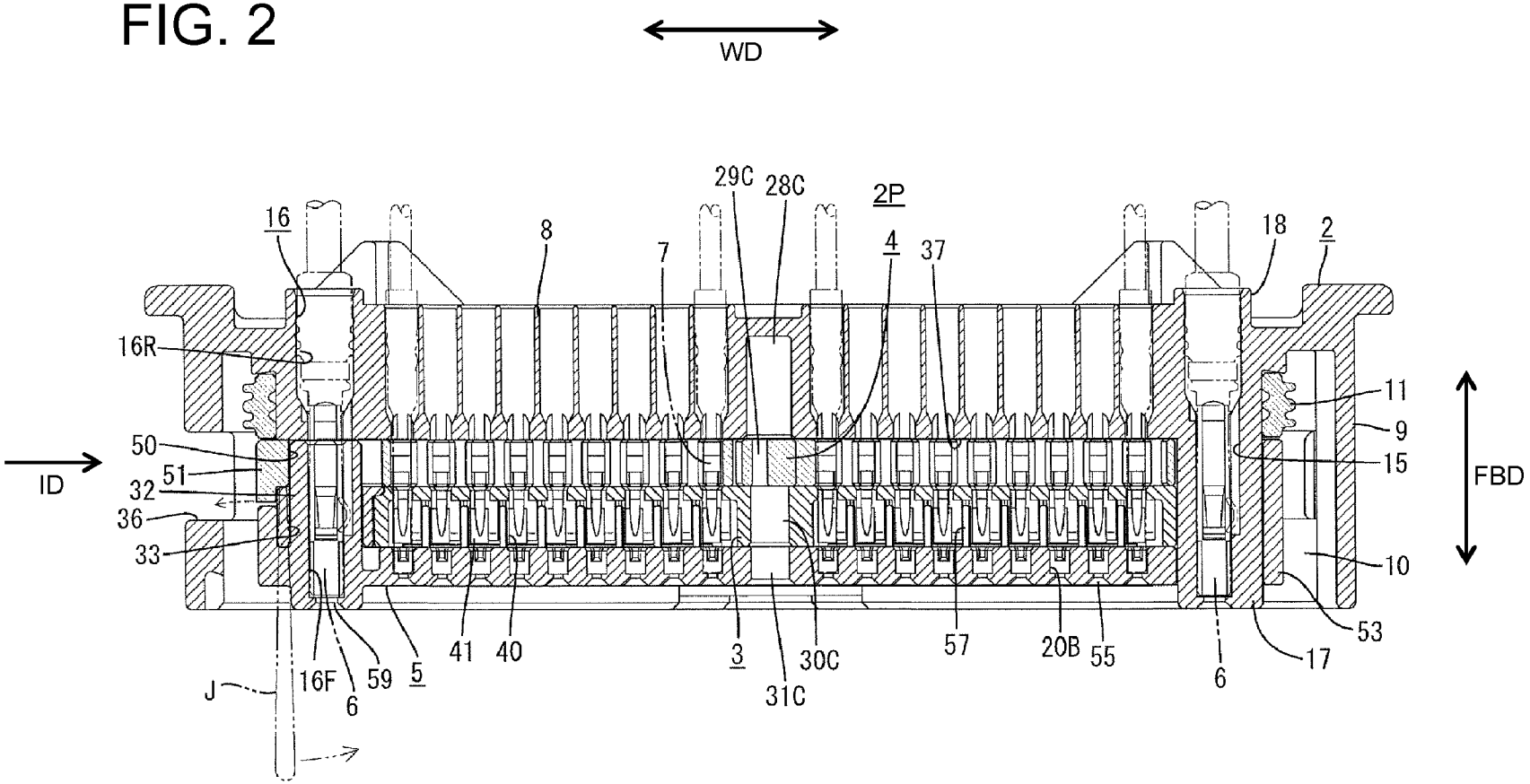
FIG. 2 is a plan view of the connector when the retainer is at a full locking position.
Figure 3:
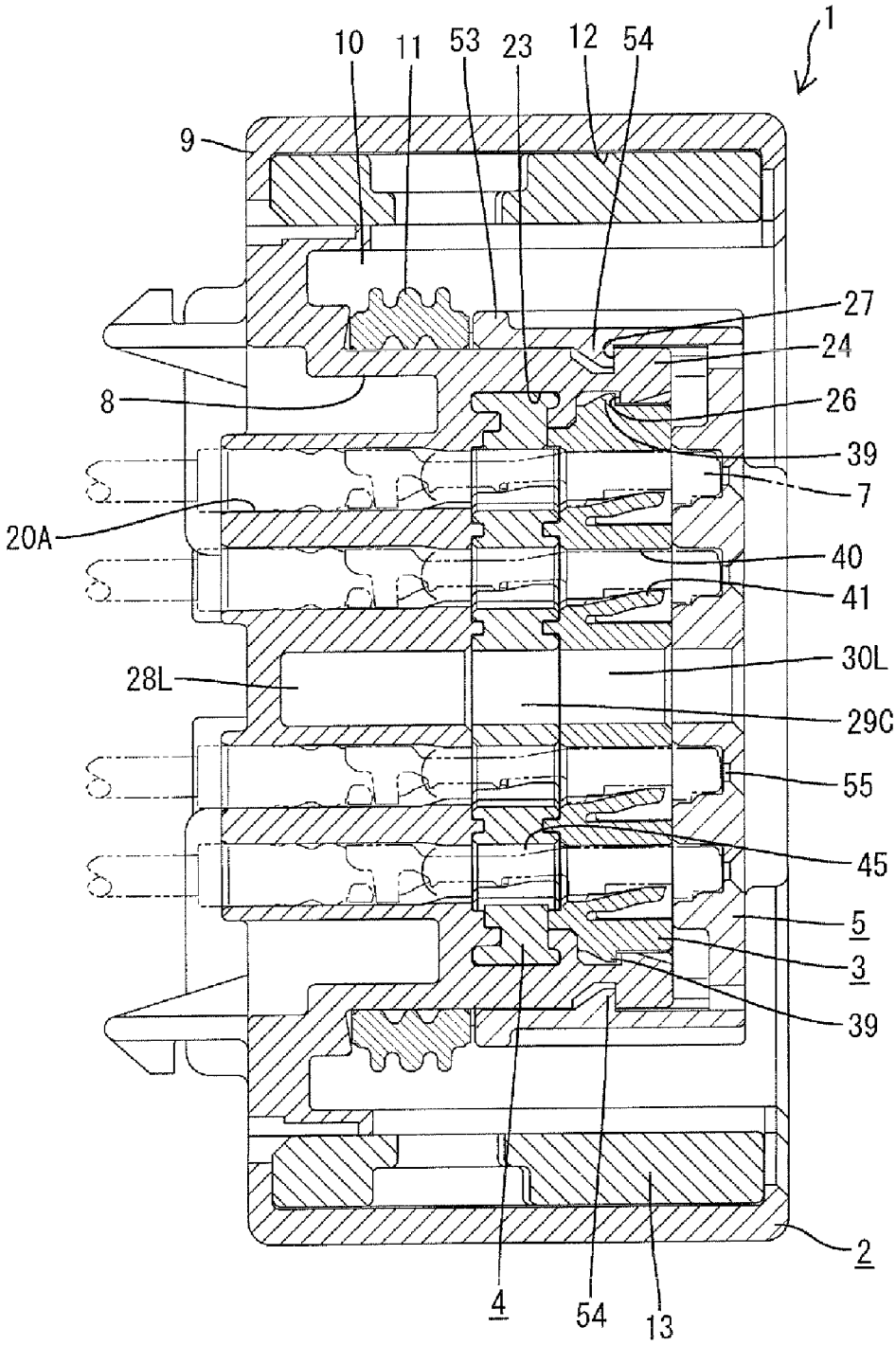
FIG. 3 is a side view in section showing smaller cavities.

Upper and lower escaping windows 50 are formed at the back side of the retainer 4 with respect to the inserting direction ID and at positions corresponding to the rear halves 16A of the front-side large cavities 16. The escaping windows 50 are dimensioned to receive the tubular bodies 32 of the front holder 5 while permitting movements of the retainer 4 between the partial locking position 1P and the full locking position 2P. An operable portion 51 is formed at the side surface of the retainer 4 near the escaping windows 50 for pushing the retainer 4. The operable portion 51 is in the lever accommodating portion 9 of the housing main body 2 when the retainer 4 is at the partial locking position 1P, but projects out from an outer end of the front holder 5. However, the operable portion 51 is flush with the outer end of the front holder 5 when the retainer 4 is moved to the full locking position 2P, as shown in FIG. 2.

The front holder 5 is formed unitarily e.g. of the synthetic resin and is assembled from the front onto the front of the lance housing 3. The front holder 5 includes a base plate 52 configured to face the front surface of the terminal accommodating portion 8 and a fitting frame 53 projects back from the outer peripheral edge of the base plate 52. Hooking claws 54 are formed at three positions on the inner side of each of the upper and lower pieces of the fitting frame 53. The hooking claws 54 are engageable with the outer locking steps 27 of the housing main body 2 to prevent the front holder 5 from coming out of the housing main body 2.

The front holder 5 has insertion holes 55 substantially coaxially corresponding to the respective intermediate chambers 40 of the lance housing 3, and tabs are insertable through these holes. Jig insertion holes 56 are formed at the opening edge of the entrance of each insertion hole 55 at positions corresponding to the unlocking piece 42 of the locking lance 41. A disengaging jig is insertable through the jig insertion hole 56 for disengaging the locking lance 41 from the small terminal 7, and the unlocking piece 42 can be operated by the disengaging jig inserted through this hole. In this way, the locking lance 41 can be disengaged from the small terminal 7 for unlocking.

On the other hand, front end chambers 20B are formed adjacent to and behind the respective insertion holes 55 in the base plate 52 for accommodating the front end portions of the small terminals 7. Vertical partitioning pieces 57 project back from the rear surface of the base plate 52 between the front end chambers 20B adjacent in width direction WD. The respective partitioning pieces 57 are inserted along the receiving grooves 43 of the lance housing 3 as the front holder 5 is assembled, thereby forming side walls of the intermediate chambers 40 of the lance housing 3.

A fitting window 58 is formed at a position of the base plate 52 facing the back-side large cavities 15 and can receive the large cavity tubes 17. The tubular bodies 32 are substantially rectangular and horizontally project back at positions of the base plate 52 facing the rear halves 16R of the front-side large cavities 16. The tubular bodies 32 can align with and pass through the corresponding through holes 33, and contact the wall surface of the housing main body 2 at the entrances of the rear halves 16R of the front-side large cavities 16 as the front holder 5 is assembled. The front halves 16F of the front-side large cavities 16 are formed inside the tubular bodies 32, and align with the rear halves 16R to communicate therewith. Thus, the entire front-side large cavities 16 are formed. Tab insertion holes 59 are formed in the front surfaces of the tubular bodies 32 for receiving the male tabs. A resiliently deformable lance 14 is cantilevered unitarily from the rear end of the front portion half 16F of each front-side large cavity 16. The lances 14 differ from the lances 19 formed unitarily in the back-side large cavities 15 and are separate from the housing main body 2. With the front holder 5 assembled with the housing main body 2, the positions of the separate lances 14 are set on a passage route of the retainer 4 when the retainer 4 is inserted in the inserting direction ID into the retainer accommodating hole 37 behind the positions of the lances 41 in the smaller cavities 20.

Figure 11:
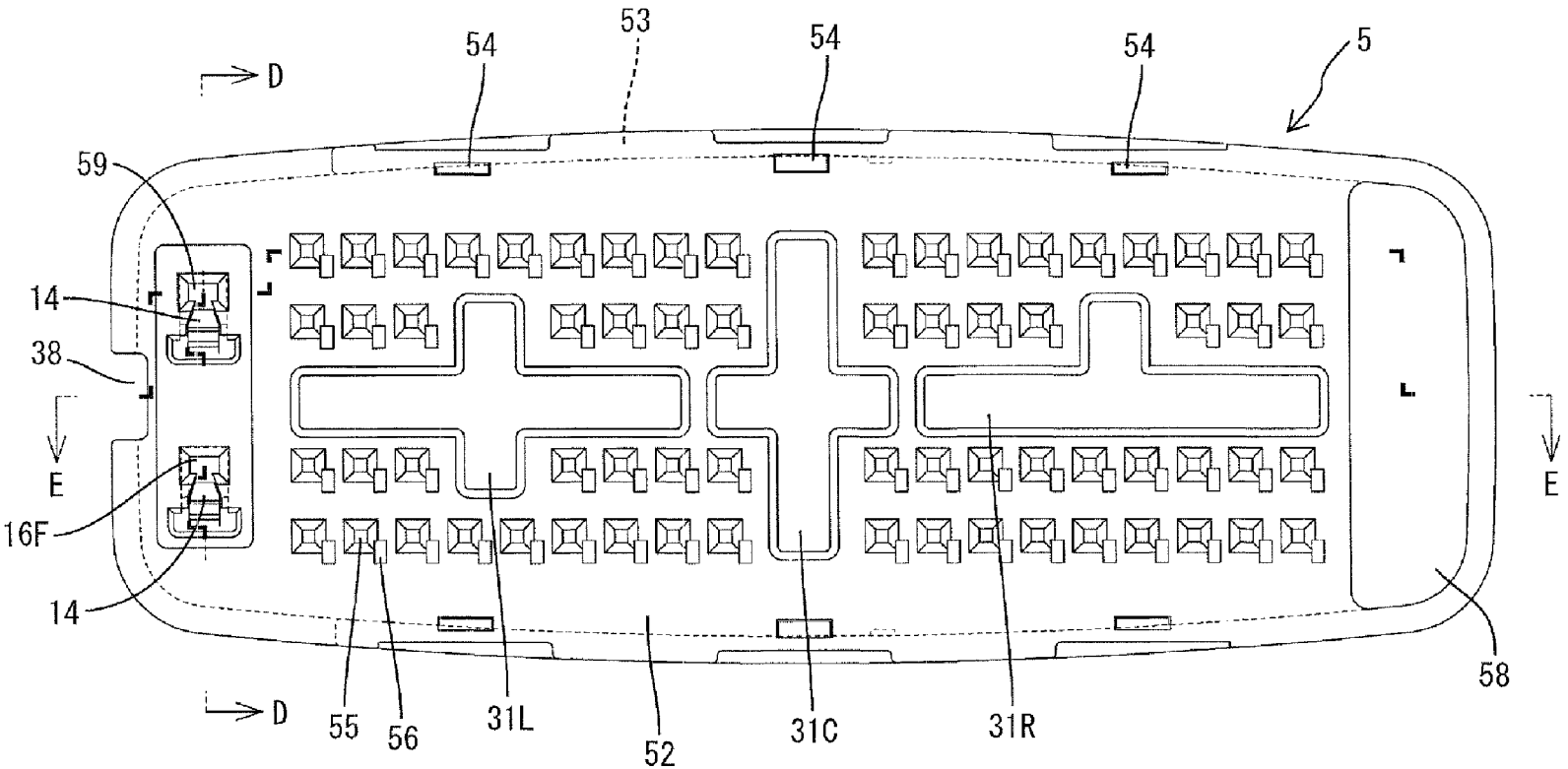
FIG. 11 is a front view of a front holder.
Figure 12:
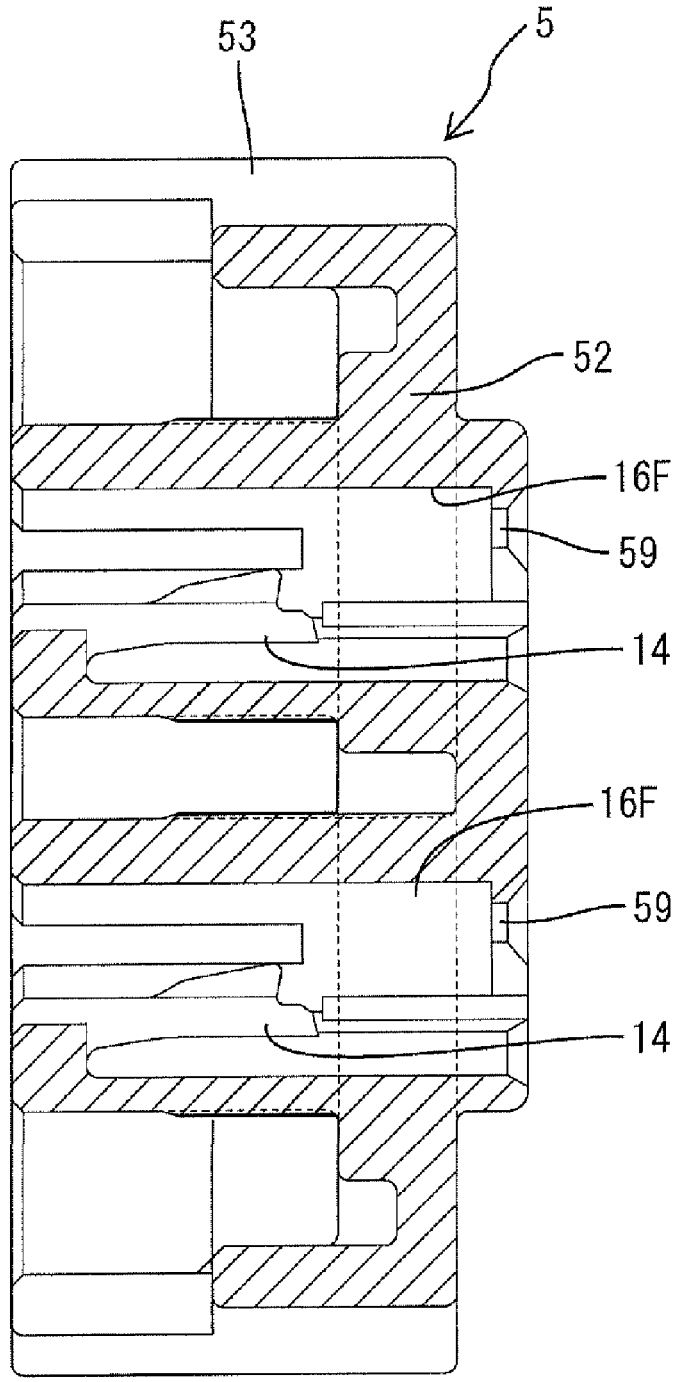
FIG. 12 is a section along D-D of FIG. 11.
Figure 13:
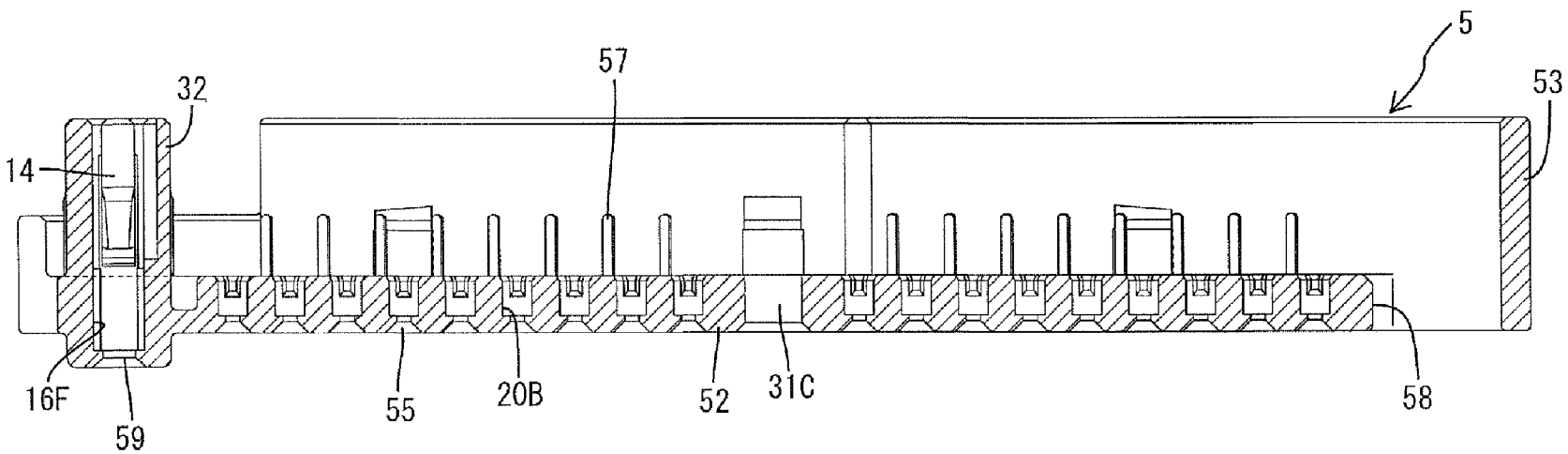
FIG. 13 is a section along E-E of FIG. 11.
Figure 14:
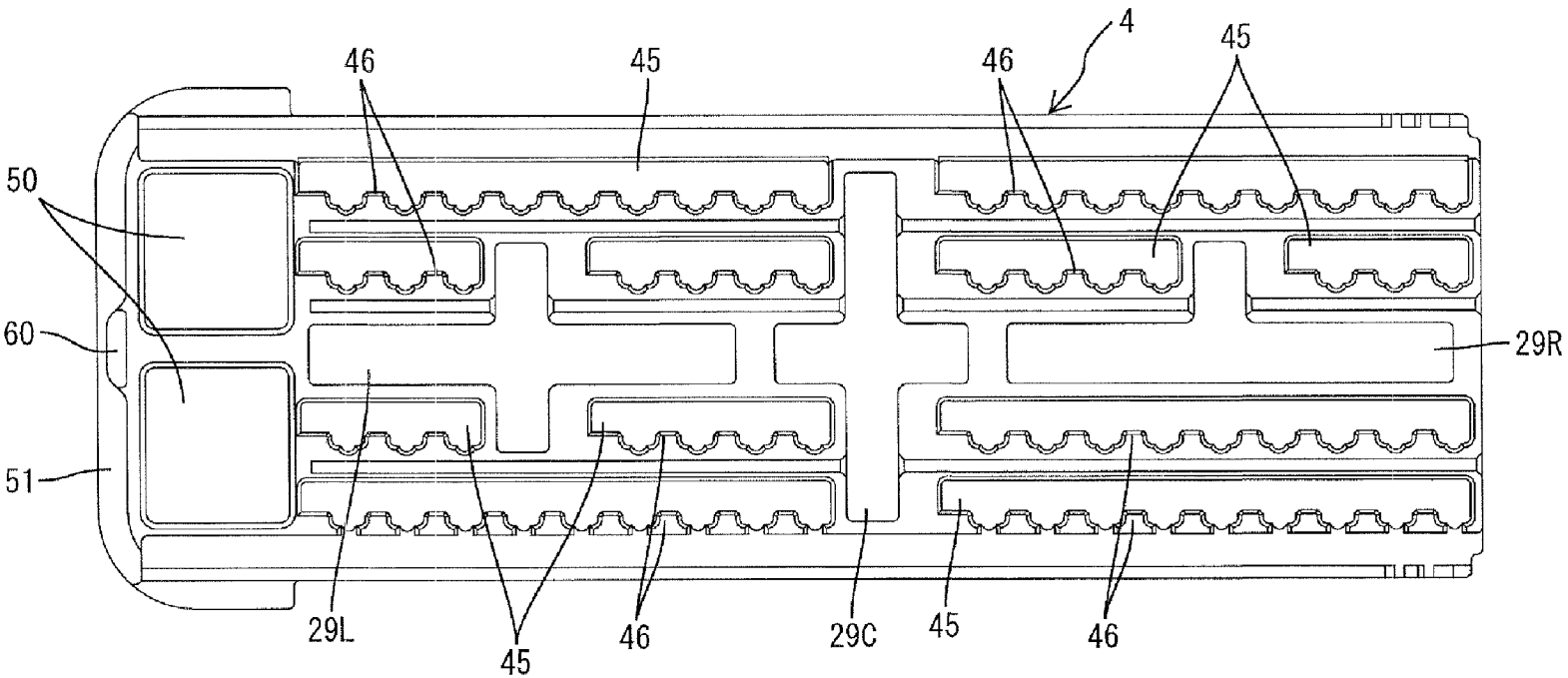
FIG. 14 is a front view of the retainer.

The cutout recess 38 is formed in an intermediate height position on the side of the front holder 5 where the separate lances 14 are arranged, and is exposed to the outside (see FIG. 11). A catching recess 60 is formed at a height position between the two escaping windows 50 at the side of the retainer 4 where the escaping windows 50 are formed. Although not shown in detail, the catching recess 60 can be seen through the cutout recess 38 from the front when the retainer 4 is at the full locking position 2P. Accordingly, a disengaging jig J can be inserted straight through the cutout recess 38 and into the catching recess 60 as shown by imaginary line in FIG. 2 to cancel the fully locked state of the retainer 4. The jig J then is moved forcibly to the right in a horizontal plane, as shown by imaginary line in FIG. 1, to disengage the full locking claw 49 from the full engaging portion (not shown).

The connector is assembled by first mounting the lance housing 3 to the housing main body 2 from the front while the positioning projection 44 is aligned with the escaping groove 35. The hooking claws 39 at the upper and lower sides of the lance housing 3 engage the inner locking steps 26 to retain the lance housing 3. At this time, the space forming the retainer accommodating hole 37 is defined between the rear surface of the lance housing 3 and the front surface of the housing main body 2.

Subsequently, the retainer 4 is inserted in the inserting direction ID into the retainer accommodating hole 37 through the insertion window 36 to engage the partial locking claws 48 with the unillustrated partial engaging portions of the housing main body 2. In this way, the retainer 4 is held at the partial locking position 1P, shown in FIG. 1.

The base plate 52 of the front holder 5 then is opposed to the front surface of the lance housing 3. The large cavity tubes 17 then are fit into the fitting window 58, and the tubular bodies 32 are inserted through the corresponding through holes 33 and into the corresponding escaping windows 50 of the retainer 4. The hooking claws 54 engage with the outer locking steps 27 to fix and position the front holder 5. The rear chambers 20A of the housing main body 2, the respective intermediate chambers 40 of the lance housing 3 and the front end chambers 20B of the front holder 5 all are arranged substantially coaxially to form the small cavities 20 when the front holder 5 is fixed and the retainer 4 is at the partial locking position 1P. Additionally, the terminal holes 45 of the retainer 4 communicate with the small cavities 20. Substantially simultaneously, the front-side large cavities 16 are formed by the substantially coaxial communication of the rear portions 16R and the front portions 16F. As the front holder 5 is mounted, the respective partitioning pieces 57 are fitted along the corresponding receiving grooves 43 of the lance housing 3 to partition the adjacent intermediate chambers 40.

Usually, the connector is transported to a terminal fitting inserting site with the housing main body 2, the lance housing 3, the retainer 4 and the front holder 5 assembled in this way. The large terminals 6 then are inserted into the back side and front-side large cavities 15, 16. The large terminals 6 are locked by the integral lances 19 in the back-side large cavities 15 while being locked by the separate lances 14 in the front-side large cavities 16. On the other hand, when being inserted into the respective small cavities 20, the small terminals 7 are locked by the respective lances 41 in the lance housing 3.

The operable portion 51 of the retainer 4 then is pushed in the inserting direction ID to move the retainer 4 from the partial locking position 1P and farther towards the front side. As a result, the locked state by the partial locking claws 48 is canceled and the full locking claws 49 engage the unillustrated full engaging portions to hold the retainer 4 at the full locking position 2P. The respective locking projections 46 engage the corresponding small terminals 7 at the full locking position 2P so that the small terminals 7 are locked doubly by the locking projections 46 and the lances 41.

Finally, the lever 13 is accommodated into the lever accommodating spaces 12 from the left in FIG. 2 to complete the assembly of the connector.

The separate lances 14 in the front-side large cavities 16 are set on the passage route of the retainer 4. These lances 14 are formed in the front holder 5 and are assembled after the insertion of the retainer 4. Thus, the lances 14 can be set on the passage route of the retainer 4. Accordingly, a degree of freedom in arranging the large and small cavities in the connector can be increased. As a result, the large cavities 15, 16 can be arranged at substantially symmetrical positions at opposite widthwise sides of the small cavities 20 even though the retainer 4 is assembled from the lateral side of the connector. With such an arrangement, the large terminals that cause large connection resistance are arranged in a laterally balanced manner. Thus, the connection resistance can be balanced laterally without being biased toward one widthwise side. Further, a heated state caused by power application also can be balanced laterally.

The holder 5 enables the lances 14 to be formed unitarily in the front side large cavities 16 and separately from the housing main body 2. Thus, the number of constituent parts can be reduced and the construction of the entire connector can be simplified by utilizing the existing parts.

The front holder 5 is assembled after the mounting of the retainer 4. However, the retainer 4 is formed with the escaping windows 50 and can be moved easily from the partial locking position 1P to the full locking position 2P. The operable portion 51 is retracted from the outer surface of the lever accommodating portion 9 when the retainer 4 is at the partial locking position 1P. Thus, there is no likelihood that an external matter will contact the operable portion 51 to move the retainer 4 inadvertently towards the full locking position 2P. Further, the tubular bodies 32 of the front holder 5 are in the escaping windows 50 when the retainer 4 is at the partial locking position and prevent the retainer 4 from coming out.

The retainer 4 also functions to retain the seal ring 11. Thus, a special part for retaining the seal ring 11 is unnecessary.

The invention is not limited to the above described and illustrated embodiment. For example, the following embodiments are also embraced by the technical scope of the present invention as defined by the claims. Besides the following embodiments, various changes can be made without departing from the gist of the present invention as defined by the claims.

The lances 41 in the small cavities 20 may be formed behind the separate lances 14 in the front-side large cavities. The large cavities 15, 16 at the front and back sides may not be located at the opposite widthwise sides of the small cavities 20 and may be located at one widthwise side or at an intermediate positions between the small cavities 20.

The lances of the small cavities 20 need not always be divided into separate parts and may be entirely formed integral to the housing main body 2.

The separate lances 14 need not be formed unitary to the front holder 5 and separate locking lances as independent parts may be assembled.

What is claimed is:

1. A connector, comprising:

a housing with cavities configured to accommodate at least parts of terminal fittings;

a retainer insertable through a side surface of the housing in an inserting direction intersecting a longitudinal direction of the cavities and engageable with the terminal fittings inserted into the cavities to retain the terminal fittings; and lances formed in the cavities for locking the terminal fitting therein, at least one of the lances being located on a passage route of the retainer and being formed on a front holder separate from the housing and insertable into the housing after insertion of the retainer.

2. The connector of claim 1, wherein the lance on the front holder is at a rear side with respect to the inserting direction of the retainer.

3. The connector of claim 1, wherein the front holder is formed with a front end portion of at least one of the cavities.

4. The connector of claim 3, wherein the lance formed on the front holder is unitary to the front holder.

5. The connector of claim 1, wherein the cavities located at back and front sides with respect to the inserting direction of the retainer are large cavities for large terminal fittings.

6. The connector of claim 5, wherein small cavities for small terminal fittings are located between the large cavities.

7. The connector of claim 6, wherein the large cavities located at the back side with respect to the inserting direction of the retainer have lances formed unitarily with the holder, and the large cavities located at the front side with respect to the inserting direction of the retainer have lances formed unitarily with the housing.

8. The connector of claim 7, wherein the front holder includes tubular bodies with the lances formed inside.

9. The connector of claim 8, wherein the tubular bodies are located at the back side with respect to the inserting direction of the retainer when the front holder is mounted.

10. The connector of claim 9, wherein the retainer is movable between a first position for permitting insertion of the terminal fittings into the cavities, and a second position for locking the terminal fittings in the cavities.

11. The connector of claim 10, wherein the retainer is formed with an operable portion projecting laterally outwardly of the tubular bodies while avoiding the interference with the tubular bodies.

12. The connector of claim 1, wherein a seal ring for providing sealing between the housing and a mating housing is provided at an inner back side of the housing and is located more backward than the retainer to be retained by the retainer.

13. A connector, comprising:

a housing with opposite front and rear ends and cavities extending at least partly from the front end to the rear end of the housing, the cavities being configured to accommodate at least parts of terminal fittings, lances formed unitarily with the housing and projecting respectively into a plurality of the cavities for locking the terminal fittings therein, at least one of the cavities in the housing having no lance;

a retainer insertable through a side surface of the housing in an inserting direction intersecting a longitudinal direction of the cavities and engageable with all of the terminal fittings in the cavities to retain the terminal fittings; and a front holder mounted to the front end of the housing and located at least partly on a passage route of the retainer, the front holder being formed with at least one lance corresponding to the at least one cavity of the housing that has no lance, the lance in the holder being configured for locking the terminal fitting in the corresponding cavity.

14. The connector of claim 13, wherein the lance on the front holder is at a trailing end with respect to the inserting direction of the retainer.

15. The connector of claim 13, wherein the front holder defines a front end portion of at least the cavity that has no lance.

16. The connector of claim 15, wherein the lance formed on the front holder is unitary to the front holder.

17. The connector of claim 13, wherein the cavities located at leading and trailing ends with respect to the inserting direction of the retainer are large cavities for large terminal fittings, and wherein small cavities for small terminal fittings are located between the large cavities.

18. The connector of claim 17, wherein the large cavities located at the trailing end with respect to the inserting direction of the retainer have lances formed unitarily with the holder, and the large cavities located at the leading end with respect to the inserting direction of the retainer have lances formed unitarily with the housing.

19. The connector of claim 18, wherein the front holder includes at least one tubular body, the lance of the front holder being formed inside tubular body, the tubular body being located at the trailing end with respect to the inserting direction of the retainer when the front holder is mounted and passing through a window in the retainer.

20. The connector of claim 19, wherein the retainer is movable between a first position for permitting insertion of the terminal fittings into the cavities, and a second position for locking the terminal fittings in the cavities, the window being sufficiently large to accommodate the tubular body as the retainer is moved from the first position to the second position.

* * * * *